United States Patent [19]

Almor

[11] Patent Number: 4,488,520

[45] Date of Patent: Dec. 18, 1984

[54] VALVE ROCKER ASSEMBLY

[75] Inventor: Emil Almor, Ilford, England

[73] Assignee: Ford Motor Company, Dearborn, Mich.

[21] Appl. No.: 518,226

[22] Filed: Jul. 28, 1983

[30] Foreign Application Priority Data

Aug. 18, 1982 [GB] United Kingdom ..... 8223743

[51] Int. Cl.[3] ..... F01L 1/46

[52] U.S. Cl. ..... 123/90.39; 123/90.36

[58] Field of Search ..... 123/90.36, 90.39, 90.41

[56] References Cited

U.S. PATENT DOCUMENTS 2,298,981 10/1942 Smith ..... 123/90.39
2,908,262 10/1959 Gropp ..... 123/90.39
3,139,872 7/1964 Thompson ..... 123/90.41
4,402,284 9/1983 Honna ..... 123/90.39

*Primary Examiner*—Michael Koczo
*Assistant Examiner*—Peggy A. Neils
*Attorney, Agent, or Firm*—Robert E. McCollum; Clifford L. Sadler

[57] ABSTRACT

An internal combustion engine having a rocker arm shaft pivotally mounting a number of rocker arms mounts the arms in pairs, the rocker arms of each pair straddling a pedestal supporting the shaft and being resiliently biased axially towards one another and against the pedestal by a one piece wire spring clip that resiliently surrounds and engages the rocker shaft and axially bears against the rocker arms.

1 Claim, 4 Drawing Figures

VALVE ROCKER ASSEMBLY

DESCRIPTION

This invention relates to valve rocker assemblies for internal combustion engines.

Conventional valve rocker assemblies of internal combustion engines comprise a rocker shaft mounted in pedestals which are usually bolted to the cylinder head of the engine. Rocker arms are pivotally mounted on the rocker shaft and are positioned axially on the rocker shaft by compression springs mounted coaxially with the rocker shaft.

This construction suffers from the disadvantages that the use of compression springs places a high axial load on the rocker arms thereby increasing the friction in the system. Additionally, in order to remove a defective compression spring, the rocker shaft must be removed completely from the pedestals and the rocker arms. The components must then be reassembled on to the rocker shaft with the new spring. This is a laborious and time consuming operation.

GB No. 2069602A discloses a rocker assembly in which the conventional compression springs are replaced by a holding member which is bolted to the pedestal. The holding member is formed partially as a leaf spring so as to clasp both sides of the rocker arm, and to retain the rocker arm in a desired axial position along the rocker shaft. However, this holding member is a complex pressing of the sheet metal, and is therefore difficult to produce. It also requires a separate bolt to secure it to the pedestal.

According to the present invention, there is provided a valve rocker assembly for an internal combustion engine comprising a rocker shaft, pedestals for mounting the rocker shaft on an engine cylinder head, rocker arms pivotally mounted on the rocker shaft and a holding member removably mounted on the rocker shaft and acting on the rocker arms to position the rocker arms axially on the rocker shaft relative to the pedestals, characterised in that the holding member comprise a wire clip comprising two axially-spaced loops engaging the rocker shaft circumferentially and each exerting an axial load on a respective rocker arm.

By forming the holding member as a removable wire clip, the assembly can be constructed and repaired more quickly than the conventional valve rocker assemblies incorporating compression springs; and the axial loads on the rocker arms can be reduced. Moreover the wire clip can be formed easily and cheaply, and requires little or no separate securing means to retain it on the rocker shaft.

Preferably the clip engages two rocker arms on opposite sides of a pedestal and biases both rocker arms axially towards the pedestal. Conventionally, a center portion of the clip extending axially between the two loops engages the pedestal between two rocker arms and is restrained by the pedestal against rotational movement about the axis of the rocker shaft. For example, the central portion of the spring may be engaged in an axial groove or recess in the bearing.

A preferred embodiment of the invention will now be described, by way of example only, with reference to the accompanying drawings, in which.

Figure 1:
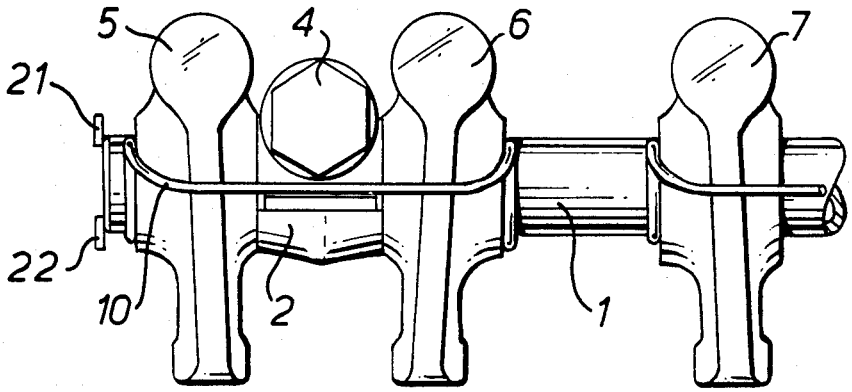
FIG. 1 is a plan of part of a valve rocker assembly in accordance with the invention.

Referring to the drawings, a valve rocker assembly comprises a hollow rocker shaft 1 which is mounted in four axially spaced pedestals 2 each of which is bolted to a cylinder head 3 of an engine by a bolt 4 which passes through a bolt hole in the pedestal 2 and engages with a part-cylinder recess in the outer wall of the rocker shaft 1 thereby preventing the rocker shaft 1 from moving axially relative to the pedestals 2.

On each side of each pedestal 2 is mounted a rocker arm 5, 6, 7 of conventional shape which is pivotable about the axis of the rocker shaft 1.

Figure 2:
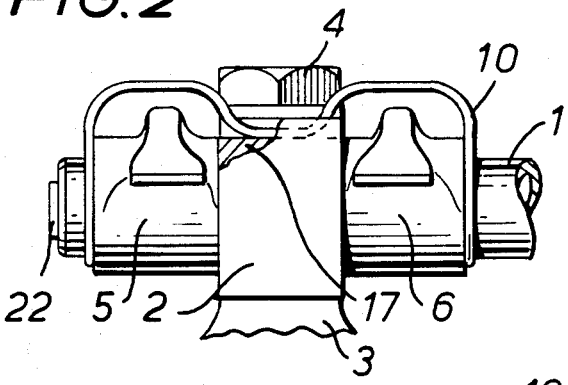
FIG. 2 is an elevation thereof.
Figure 3:
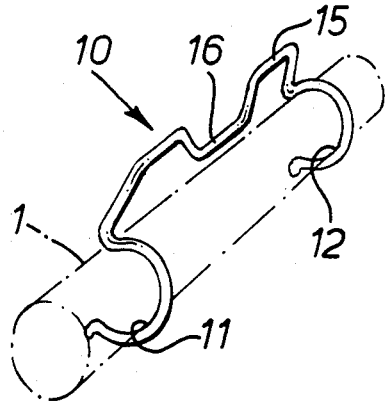
FIG. 3 is a perspective view of a spring clip used in the assembly of FIGS. 1 and 2.

Each pair of rocker arms 5,6 on opposite sides of each pedestal 2 is retained in engagement with the adjacent side of the pedestal 2 by means of a spring clip 10. As best seen in FIG. 3, the spring clip 10 is made from a single piece of spring metal wire. If desired, the spring clip 10 may be formed from a suitably shaped resilient plastics material or spring metal sheet. The spring clip 10 comprises two C-shaped loops 11,12 which extend circumferentially around the rocker shaft 1 at two axially spaced locations, and a central portion 15 which extends axially between the two loops 11,12. The central portion 15 includes a radially inwardly projection section 16 which engages in an axial groove 17 (FIG. 2) in the pedestal 2 to prevent rotation of the spring clip 10 about the axis of the rocker shaft 1.

The spring clips 10 are shaped to exert an axial compressive force on the two rocker arms 5,6 with which they engage so that the rocker arms 5,6 are held in abutment with the pedestal 2. This load is however relatively light and does not generate significant frictional resistance to the pivotal movement of the rocker arms 5,6 on the rocker shaft 1.

Figure 4:
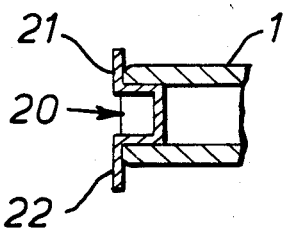
FIG. 4 is an axial cross-section one end portion of the assembly of FIGS. 1 and 2.

Referring to FIG. 4, an end cap 20 is received in a conventional manner in the end of the hollow rocker shaft 1 as a friction fit in order to seal the hollow bore of the rocker shaft 1. The end cap 20 includes two radial tangs 21,22 which project radially beyond the outer wall of the rocker shaft 1. These tangs prevent the rocker arms 5,6,7, pedestal 2, and spring clips 10 from sliding off the rocker shaft 1 when the bolts 4 are disengaged from the cylinder head 3, and removed from the pedestals 2, thereby allowing the valve rocker assembly to be assembled and transported as a unit separate from the cylinder head 3.

It will be appreciated that the spring clips 10 can be positioned on and removed from the rocker shaft 1 quickly and easily, thereby facilitating assembly and repair of the valve rocker assembly.

I claim:

1. A valve rocker assembly for an internal combustion engine comprising a rocker shaft, pedestals for mounting the rocker shaft on an engine cylinder head, rocker arms pivotally mounted on the rocker shaft such that a pair of rocker arms straddles each pedestal with each one of the pair of rocker arms contiguous thereto, and an axially extending one piece wire spring metal clip holding member resiliently removably mounted on the rocker shaft, the clip having a loop at each end resiliently circumferentially surrounding and engaging the rocker shaft, the loop being of a diameter slightly smaller than the diameter of the shaft to deform under an interference fit with the shaft upon assembly thereto for retaining the clip to the shaft, the clip having a central indented portion operably engageable in a mating groove in the pedestal for nonrotatably locating the clip relative to the rocker shaft, each clip acting on the contiguous rocker arms to position the rocker arms axially on the rocker shaft relative to the pedestal, each clip exerting a load in an axial direction on a respective rocker arm locating them axially against the pedestal.

* * * * *